US006079079A

United States Patent [19]

Oka

[11] Patent Number: 6,079,079

[45] Date of Patent: Jun. 27, 2000

[54] VACUUM CLEANER INCLUDING VENTILATION FAN FOR FORMING AIR CURRENT FLOWING ALONG THE AXIAL DIRECTION OF ROTARY BRUSH TO SUCTION MEMBER

[75] Inventor: Yasuhiro Oka, Osaka, Japan

[73] Assignee: Sharp Kabushiki Kaisha, Osaka, Japan

[21] Appl. No.: 09/203,367

[22] Filed: Dec. 2, 1998

[30] Foreign Application Priority Data

Jan. 21, 1998 [JP] Japan ..... 10-009485P

[51] Int. Cl.[7] ..... A47L 5/10

[52] U.S. Cl. ..... 15/375; 15/387

[58] Field of Search ..... 15/375, 376, 387, 15/351

[56] References Cited

U.S. PATENT DOCUMENTS

| | | | |
|---|---|---|---|
| 1,323,925 | 12/1919 | Stewart | 15/387 X |
| 1,718,293 | 6/1929 | Hoover | 15/376 X |
| 2,085,700 | 6/1937 | Kitto | 15/375 |
| 2,993,224 | 7/1961 | Child | 15/387 |
| 4,159,555 | 7/1979 | Schneider . | |
| 4,594,749 | 6/1986 | Waterman | 15/375 X |
| 5,560,074 | 10/1996 | Graham et al. | 15/331 X |

FOREIGN PATENT DOCUMENTS

| | | |
|---|---|---|
| 57-21341 | 5/1982 | Japan . |
| 2320421 | 6/1998 | United Kingdom . |

*Primary Examiner*—Chris K. Moore
*Attorney, Agent, or Firm*—Birch, Stewart Kolasch & Birch, LLP

[57] ABSTRACT

A vacuum cleaner with high efficiency in sucking dust includes a main body and a floor nozzle pivotally coupled to the main body. The body includes a body cover, and within the body, a fan motor and a dust-collecting bag mounting portion. The floor nozzle includes a floor nozzle cover having an opening at its surface in contact with a floor and a suction member on its wall against the body, a rotary brush member arranged to face the opening and driven by the fan motor, and a ventilation fan provided at an end of the rotary brush member and rotating according to rotation of the rotary brush member. The body further includes a hose with one end connected to the suction member and the other end connected to the dust-collecting bag mounting portion. The vacuum cleaner further includes a driving member for driving the rotary brush member and the ventilation fan.

3 Claims, 7 Drawing Sheets

VACUUM CLEANER INCLUDING VENTILATION FAN FOR FORMING AIR CURRENT FLOWING ALONG THE AXIAL DIRECTION OF ROTARY BRUSH TO SUCTION MEMBER

BACKGROUND OF THE INVENTION

1. Field of the Invention

The present invention relates to a vacuum cleaner, and particularly to a vacuum cleaner with an improved dust collecting capability.

2. Description of the Background Art

Vacuum cleaners are generally classified into those of a canister type and of an upright type. When cleaning with the canister type vacuum cleaner, one must drag through a long hose the body of the cleaner, in which an electric motor is stored, to move its suction opening to a place to be cleaned. The upright type cleaner, however, has a body with such a suction opening and an electric motor integrated therein, which allows easy operation.

Referring to FIGS. 1 and 2, a conventional upright type vacuum cleaner includes a main body 1; a handle 1-1 attached to an upper portion of the body 1 for operating the cleaner; wheels 2 attached to a lower portion of body 1 and rotating corresponding to the operation of handle 1-1; a fan motor 3 for exhaust contained in a lower portion of body 1; a dust-collecting bag 1-2 contained within body 1 above fan motor 3; a hose 11; a floor nozzle 5, pivotally attached to body 1 with an angle in a certain range by attaching means with a coaxial shaft 4 of fan motor 3 as its pivot, and in communication with dust-collecting bag 1-2 via hose 11; a rotary brush member 7 provided within floor nozzle 5; a pulley (not shown) attached to an end of rotary brush member 7; a belt 6 suspended between coaxial shaft 4 of fan motor 3 and the pulley for transmitting the power of fan motor 3 to rotary brush member 7; an extension pipe 11-1 and a narrow space nozzle 11-2 both connected to a tip end of hose 11 when cleaning a corner of a room, a space between pieces of furniture, etc., for cleaning such narrow spaces difficult to insert floor nozzle 5 therein; and a power supply cord (not shown). An exhaust outlet 12 for fan motor 3 is formed at a lower portion of main body 1.

Rotary brush member 7 has a surface with bristles spirally planted thereon. When cleaning a carpet, dust is raked by these bristles, and is sucked and sent into dust-collecting bag 1-2. When cleaning a floor or the like, rotation of rotary brush member 7 can be stopped.

A wall is provided around rotary brush member 7 to form a suction opening. Of the suction opening, a side in contact with a floor surface is open, whereas the other side not in contact with the floor is separated from outside-air, and the dust sucked from a suction member connected to hose 11 is sent into the dust-collecting bag. The suction member is provided in the vicinity of the center portion of rotary brush member 7, or in a structure as shown in FIG. 1, at a portion opposite to an end of rotary brush member 7.

Negative pressure around the rotary brush member decreases in proportion to the volume of the dust sucked during cleaning; sucking force decreases at a farther distance from the suction member. With a conventional vacuum cleaner, dust raked by the rotary brush member has been sucked only with sucking force provided to the suction member by fan motor 3. This has resulted in poor efficiency in sucking dust.

SUMMARY OF THE INVENTION

The present invention has been made to solve the above-described problems, and one of its objects is to provide a vacuum cleaner with high efficiency in sucking dust.

Another object of the present invention is to provide a vacuum cleaner with higher efficiency in sucking dust compared to a conventional one with the comparable part counts.

A vacuum cleaner according to an aspect of the present invention includes a main body, and a floor nozzle pivotally coupled to the main body. The body includes a body cover, and within the body, a fan motor and a dust-collecting bag mounting portion. The floor nozzle includes a floor nozzle cover having an opening at its surface in contact with a floor and a suction member on its wall against the body; a rotary brush member arranged to face the opening and driven by the fan motor; and a ventilation fan provided at an end of and rotating in accordance with the rotation of the rotary brush member. The body further includes a hose with one end connected to the suction member and the other end to the dust-collecting bag mounting portion. The vacuum cleaner further includes a driving member for driving the rotary brush member and the ventilation fan.

Provision of the ventilation fan allows air current to be formed from an end of the rotary brush towards the suction member. This facilitates introduction of dust into the suction member, thereby improving efficiency in sucking dust.

Preferably, the floor nozzle cover has an outside-air inlet at a position opposite to the ventilation fan.

The air current from the end of the rotary brush to the suction member may be increased in volume by the existence of the outside-air inlet, so that the efficiency in sucking dust will further improve.

Moreover, the ventilation fan is preferably attached to the axis of rotation of the rotary brush member.

Integration of the ventilation fan with the rotary brush member assures easy drive of the ventilation fan.

Preferably, the floor nozzle further includes a pulley attached to an end of the rotary brush member. The driving member includes a belt suspended between the fan motor and the pulley. The ventilation fan is formed within the pulley.

As the ventilation fan is provided inside the pulley rotating the rotary brush member, there is no need to widen the floor nozzle. It also becomes unnecessary to increase the part counts because of such a simple structure.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
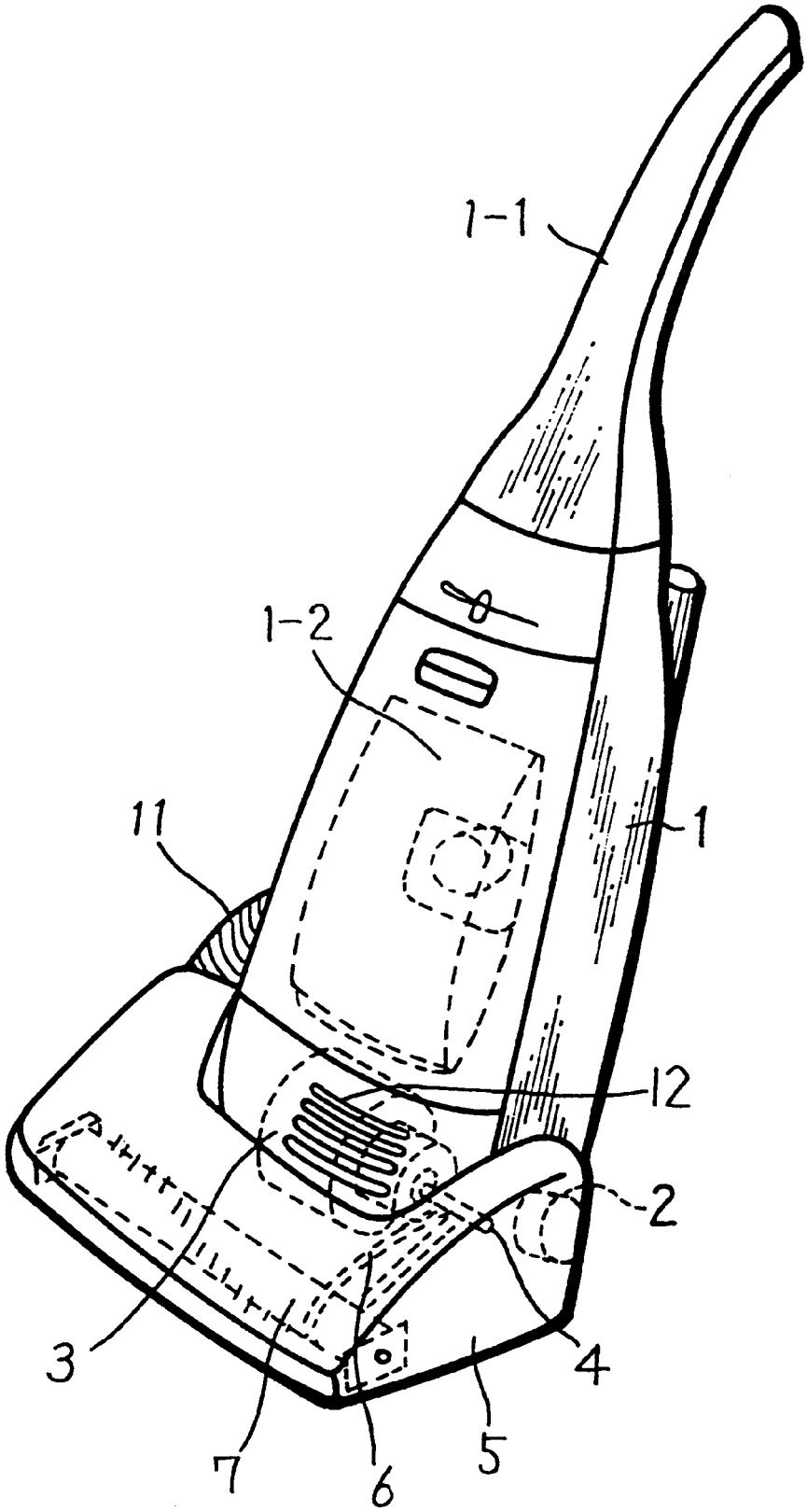
FIG. 1 PRIOR ART
FIG. 1 is a front, perspective view of a conventional upright type vacuum cleaner.
Figure 2:
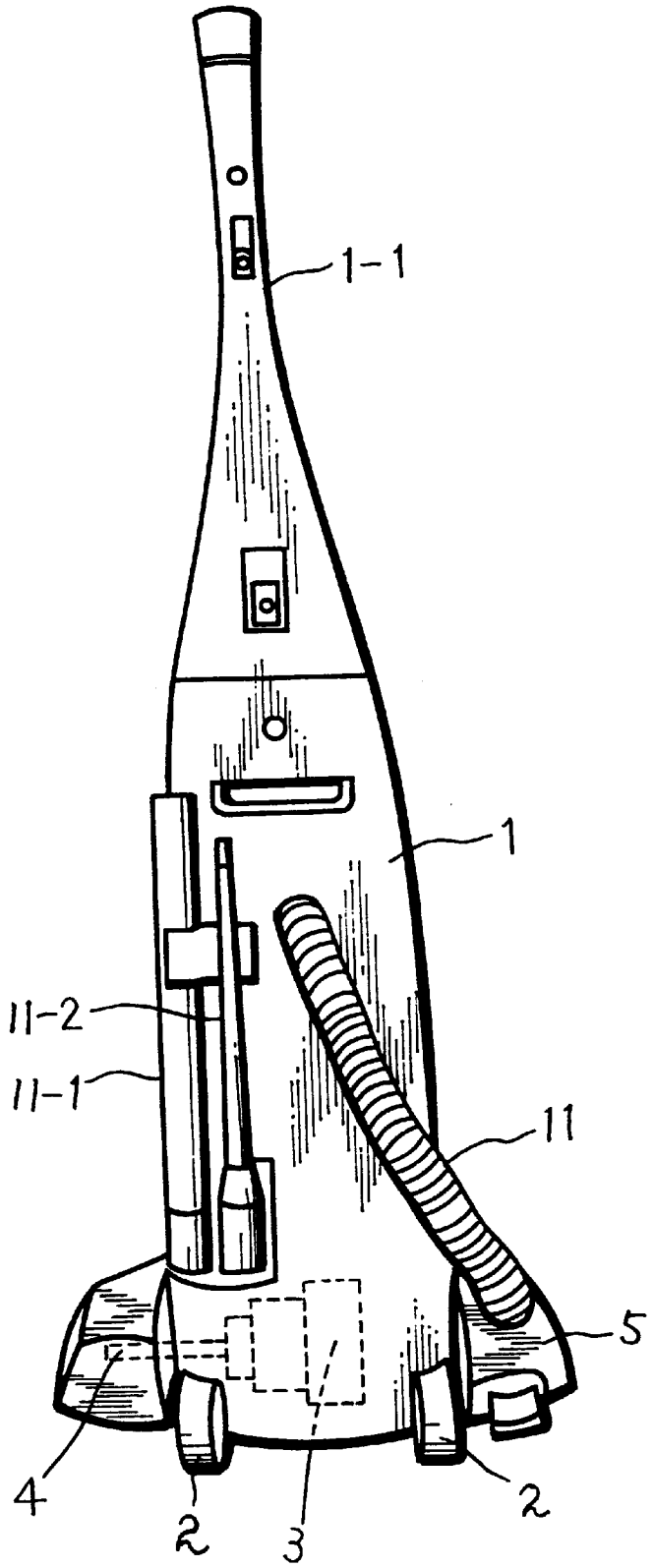
FIG.2 PRIOR ART
FIG. 2 is a rear plan view of the conventional upright type vacuum cleaner.
Figure 3:
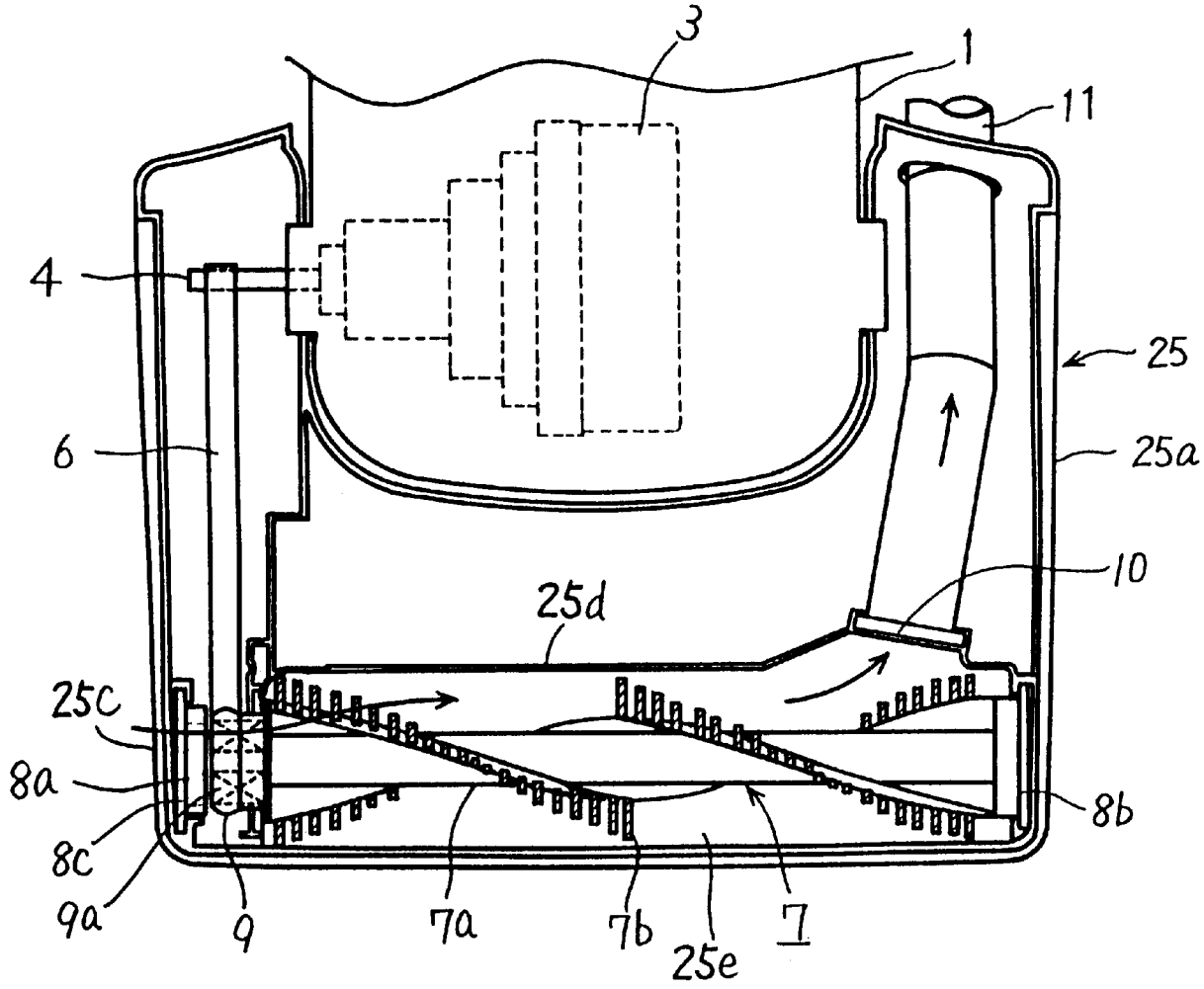
FIG. 3 is a bottom plan view of an upright type vacuum cleaner according to a first embodiment of the present invention.
Figure 4:
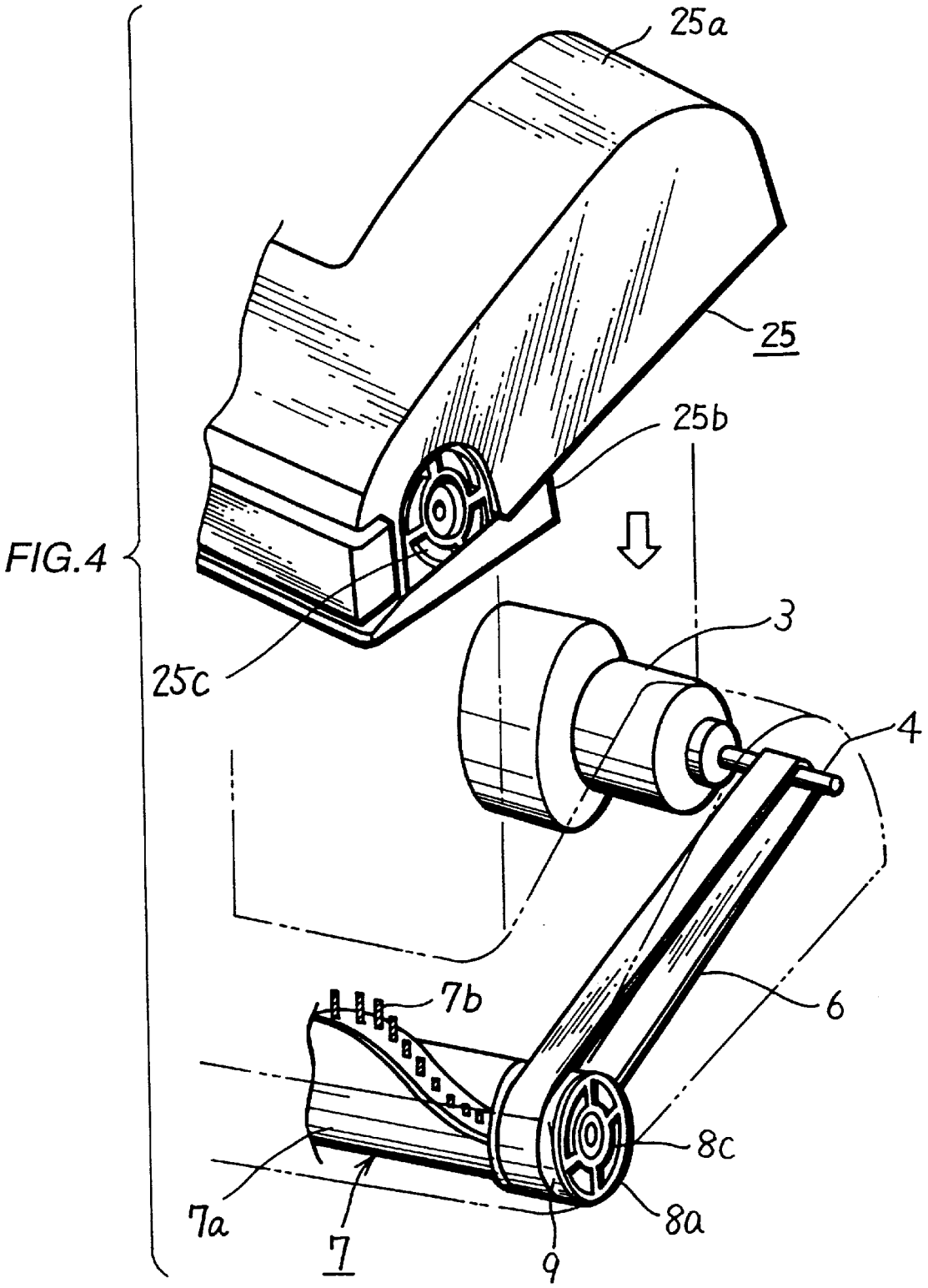
FIG. 4 is a perspective view of a main portion of the upright type vacuum cleaner according to the first embodiment.

With reference to FIGS. 3 and 4, an upright type vacuum cleaner according to the first embodiment of the present invention includes a main body 1; a fan motor 3 for exhaust contained in a lower portion of body 1 and a cover of body 1; a hose 11; a floor nozzle 25, pivotally attached by arbitrary attaching means with a coaxial shaft 4 of fan motor 3 as its pivot to body 1 with an angle in a certain range, and in communication with a dust-collecting bag (not shown) mounted in a dust-collecting bag mounting portion (not shown) by hose 11; a rotary brush member 7 provided within the floor nozzle 25; a pulley 9 attached to an end of rotary brush member 7; a belt 6 suspended between coaxial shaft 4 of fan motor 3 and pulley 9 for transmitting power of fan motor 3 to rotary brush member 7; and a ventilation fan 9*a* formed within pulley 9.

Floor nozzle 25 includes an upper cover 25*a*, a bottom cover 25*b*, and a wall 25*d* provided within upper cover 25*a*. Upper cover 25*a* and wall 25*d* form a suction opening 25*e*. An outside-air inlet 25*c* is provided on a wall surface of upper cover 25*a*, opposite to ventilation fan 9*a*. A suction member 10 is provided on a part of wall 25*d*, for communicating suction opening 25*e* with the dust-collecting bag through hose 11.

The upright type vacuum cleaner further includes bearing holders 8*a* and 8*b* provided at respective ends of rotary brush member 7 for attaching rotary brush member 7 to upper cover 25*a* of floor nozzle 25.

Rotary brush member 7 is contained in suction opening 25*e*. Of suction opening 25*e*, a portion corresponding to a floor surface is open, and dust is sucked therefrom. The sucked dust is sent via suction member 10 and hose 11 into the dust-collecting bag. Fan motor 3 effects sucking of dust.

Referring to FIG. 4, a lower portion of upper cover 25*a* of floor nozzle 25 is covered with bottom cover 25*b*, while a portion of rotary brush member 7 opposing a floor is open. Bearing holder 8*a* having a ventilation opening 8*c* at an end of rotary brush member 7 is secured by upper and bottom covers 25*a* and 25*b*.

Figure 5:
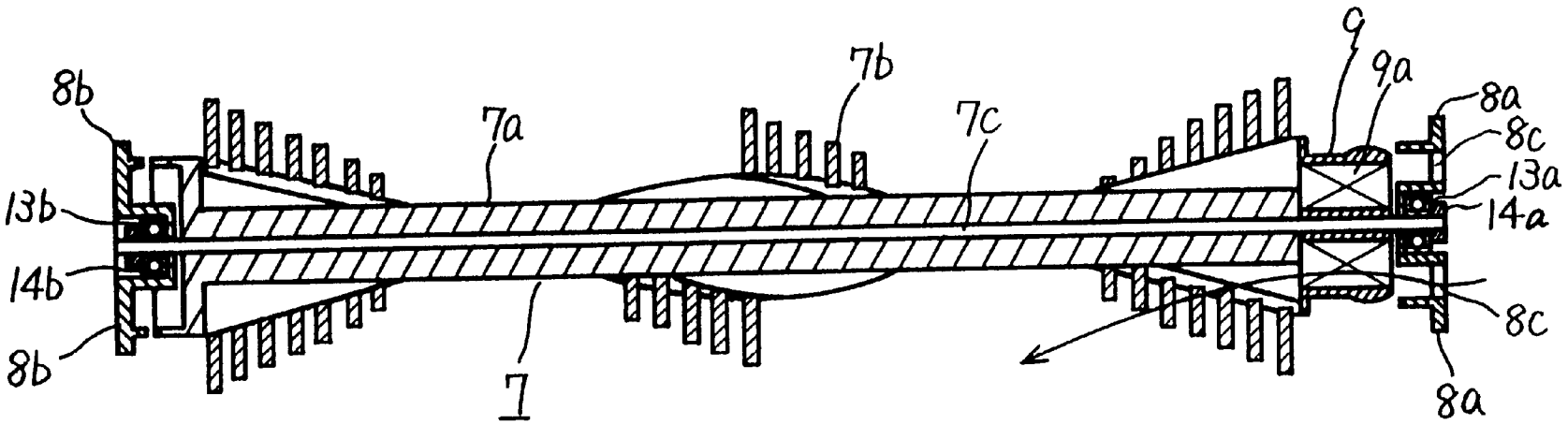
FIG. 5 is a cross sectional view of the main portion of a rotary brush member and a bearing holder according to the first embodiment.

With reference to FIG. 5, rotary brush member 7 includes a rotating body 7*a* formed by resin molding, a rotation axis 7*c* inserted into a hollow portion at the center of and integrated with rotating body 7*a*, and a brush 7*b* spirally planted on the periphery of rotating body 7*a*.

As described above, pulley 9 is secured at an end of rotating body 7*a*, inserted in and coupled to rotation axis 7*c*. Ventilation fan 9*a* is formed within pulley 9. Opposing ends of rotation axis 7*c* are detachably supported by bearing holders 8*a* and 8*b* with bearings 13*a* and 13*b* interposed, respectively. Rotation axis 7*c* is prevented from being dislodged from bearing holders 8*a* and 8*b*, by screwing nuts 14*a* and 14*b* in the respective ends of rotation axis 7*c*. Ventilation opening 8*c* for introducing air into suction opening 25*e* is provided at a flat portion of bearing holder 8*a*, opposing ventilation fan 9*a*. Rotation of pulley 9 causes rotary brush member 7 to rotate, thereby rotating ventilation fan 9*a*. Air introduced from ventilation opening 8*c* by the rotation of ventilation fan 9*a* is directed as shown by an arrow in FIG. 5, and therefore, air current is generated along rotary brush member 7 towards suction member 10.

As described above, bearing holders 8*a* and 8*b* are secured by upper and bottom covers 25*a* and 25*b*.

Ventilation fan 9*a* with a larger diameter is more preferred, although it is defined depending on the diameter of pulley 9. Preferably, the diameter of ventilation fan 9*a* is made larger than that of rotating body 7*a* so as to obtain air current as much as possible. The volume of air introduced from an outside can be altered by adjusting the number of rotation of the ventilation fan, as well as the number and angle of blades of the fan.

When the maximum negative pressure generated by rotation of fan motor 3 is represented as 100%, the vacuum cleaner is generally set to be operated with only 70 to 80% of the pressure for sucking dust, by providing a space between its nozzle and a floor surface. This is because too much negative pressure leads to difficulty in moving the cleaner. Though a certain volume of air may be introduced into the suction opening of the floor nozzle by the ventilation fan provided at the end of rotary brush member, it will have little effect on sucking force of the cleaner, because of the margin of the negative pressure. The air current formed by the ventilation fan along the rotary brush member will send dust towards the suction member. As a result, the efficiency in sucking as a whole will be increased.

Second Embodiment

Figure 6:
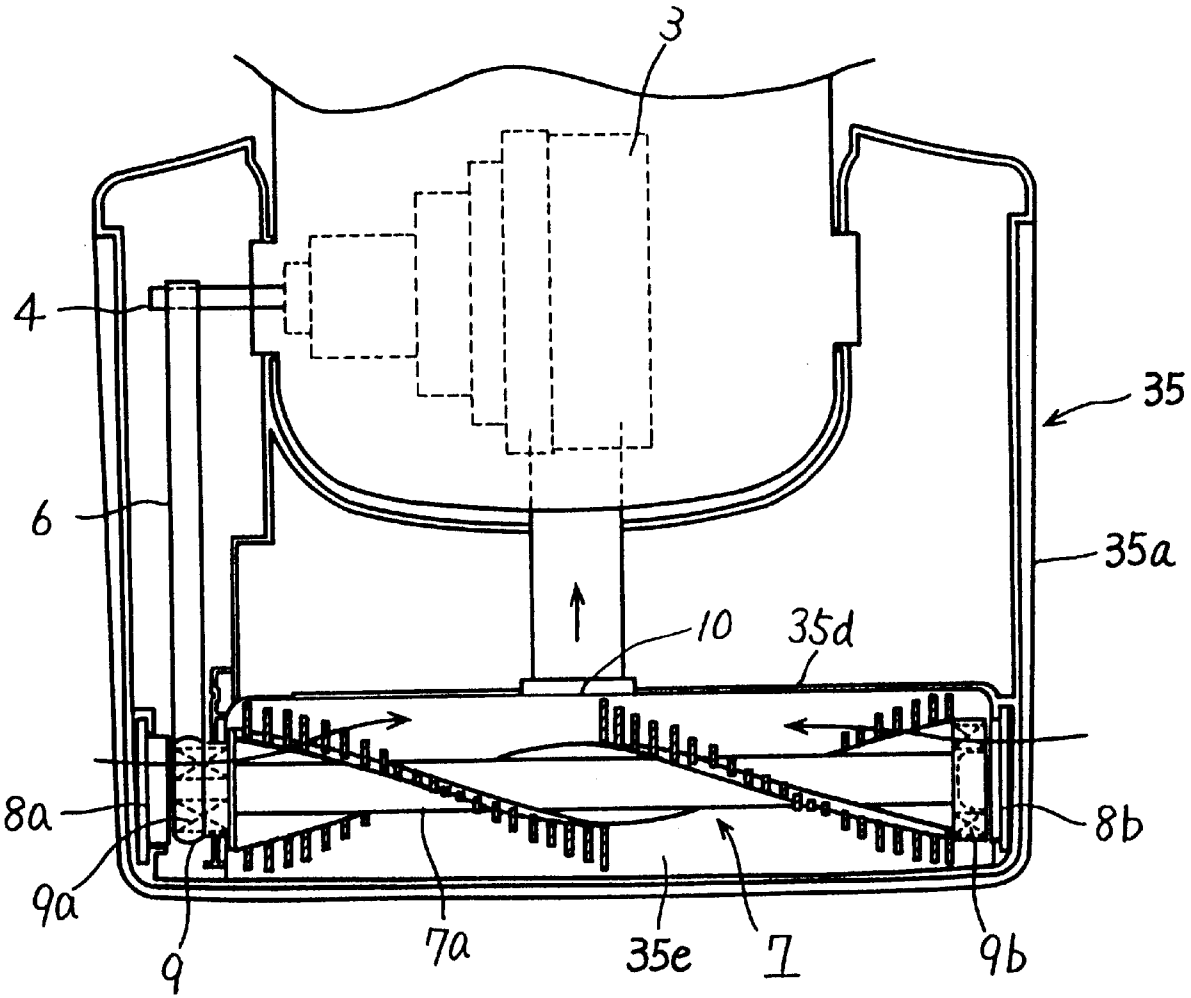
FIG. 6 is a bottom plan view of an upright type vacuum cleaner according to a second embodiment of the present invention.
Figure 7:
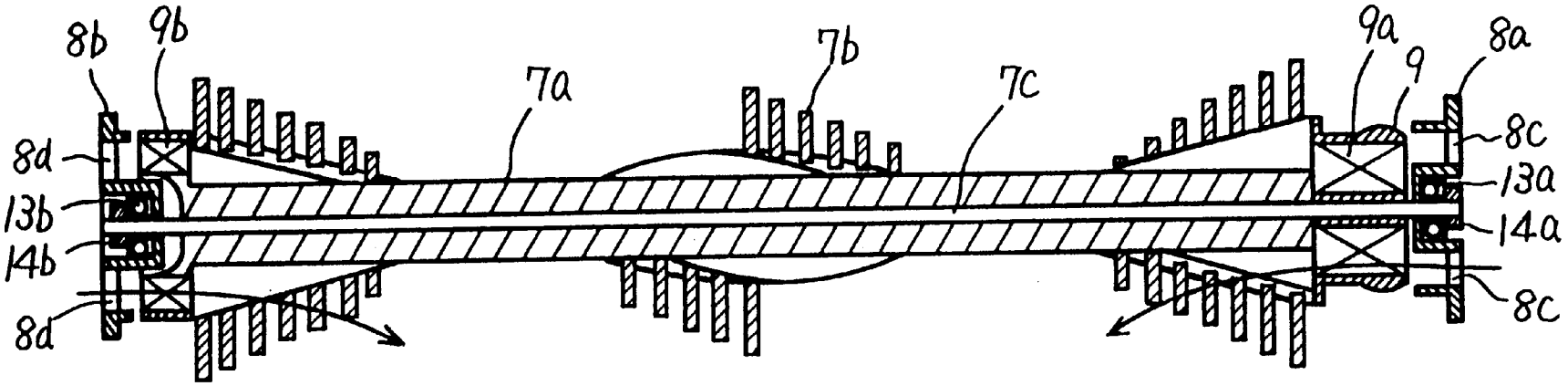
FIG. 7 is a cross sectional view of the main portion of a rotary brush member and a bearing holder according to the second embodiment.

Referring to FIGS. 6 and 7, an upright type vacuum cleaner according to the second embodiment of the present invention is basically same as the one according to the first embodiment shown in FIGS. 3 through 5. They only differ in that the former includes suction member 10 provided opposite to the center of the rotary brush member, and accordingly, ventilation fans 9*a* and 9*b* are provided at respective sides of rotary brush member 7. Ventilation openings 8*c* and 8*d* are respectively provided at portions of respective bearing holders 8*a* and 8*b*, opposite to ventilation fans 9*a* and 9*b*. Floor nozzle 35 includes upper cover 35*a*, bottom cover 25*b* (not shown), and a wall 35*d* provided within upper cover 35*a*. Upper cover 35*a* and wall 35*d* constitute a suction opening 35*e*. Although not shown, outside-air inlets are provided at respective sides of the side surface of upper cover 35*a*, opposite to ventilation fans 9*a* and 9*b*.

With reference to FIG. 7, ventilation fan 9*b* at the opposite end from pulley 9 is formed to surround the outside of a portion supporting bearing 13*b* of bearing holder 8*b*. With such a structure, it is possible to decrease the width of the floor nozzle by the length of the overlapping portion.

According to the present invention, the ventilation fan provided at an end of the rotary brush member takes in air from the outside-air inlet on the side wall of the floor nozzle member. Air current is thus generated along the rotary brush member to the suction member, which can send dust sucked from the suction opening located at a lower portion of the rotary brush member towards the suction member. This improves efficiency in sucking dust.

Integration of the ventilation fan with the rotary brush member ensures easier driving of the ventilation fan.

Provision of the ventilation fan within the pulley rotating the rotary brush member eliminates necessity to widen the floor nozzle or to increase the part counts.

An upright type vacuum cleaner has been described in the above embodiments. However, the present invention is also applicable to a canister type one, only if there is provided within the floor nozzle an electric motor dedicated for driving a rotary brush body and a ventilation fan.

Although the present invention has been described and illustrated in detail, it is dearly understood that the same is by way of illustration and example only. It is not to be taken by way of limitation, the spirit and scope of the present invention being limited only by the terms of the appended claims.

What is claimed is:

1. A vacuum cleaner, comprising:

a) a main body; and b) a floor nozzle pivotally coupled to said main body; wherein said main body includes a-1) a body cover, and a-2) a fan motor and a dust containing portion both arranged within said main body;

said floor nozzle including b-1) a floor nozzle cover having an opening at a surface thereof in contact with a floor and a suction member on a wall thereof against said main body, and including an outside-air inlet at a portion opposite to said ventilation fan, b-2) a rotary brush member arranged to face said opening and driven by said fan motor, b-3) a ventilation fan provided at an end of said rotary brush member, attached to a rotational axis of said rotary brush member, and rotating according to rotation of said rotary brush member, and b-4) a pulley attached to an end of said rotary brush member; and wherein said main body further includes a-3) a hose with one end connected to said suction member and the other end connected to said dust containing portion;

said vacuum cleaner further comprising c) driving means for driving said rotary brush member and said ventilation fan, wherein said driving means includes a belt suspended between said fan motor and said pulley; and said ventilation fan is formed within said pulley.

2. The vacuum cleaner according to claim 1, wherein said suction member is formed on said wall near one end of said rotary brush member; and said ventilation fan is provided at the other end of said rotary brush member.

3. The vacuum cleaner according to claim 1, wherein said suction member is formed on said wall near the center of said rotary brush member; and said ventilation fan is provided one at each end of said rotary brush member.

* * * * *